US008096829B2

(12) United States Patent
Malloy et al.

(10) Patent No.: US 8,096,829 B2
(45) Date of Patent: Jan. 17, 2012

(54) CENTER CONDUCTOR TERMINAL HAVING INCREASED CONTACT RESISTANCE

(75) Inventors: Allen L. Malloy, Elmira Heights, NY (US); Charles Thomas, Athens, PA (US)

(73) Assignee: Belden Inc., St. Louis, MO (US)

( * ) Notice: Subject to any disclaimer, the term of this patent is extended or adjusted under 35 U.S.C. 154(b) by 40 days.

(21) Appl. No.: 12/505,001

(22) Filed: Jul. 17, 2009

(65) Prior Publication Data

US 2010/0029149 A1 Feb. 4, 2010

Related U.S. Application Data

(60) Provisional application No. 61/084,290, filed on Jul. 29, 2008.

(51) Int. Cl.
*H01R 9/05* (2006.01)

(52) U.S. Cl. ..... 439/578; 439/843

(58) Field of Classification Search ..... 439/578, 439/843

See application file for complete search history.

(56) References Cited

U.S. PATENT DOCUMENTS 4,964,814 A * 10/1990 Tengler et al. ..... 439/607.56
5,730,628 A * 3/1998 Hawkins ..... 439/843
6,042,432 A * 3/2000 Hashizawa et al. ..... 439/843
6,264,508 B1 * 7/2001 Lehmann ..... 439/843
6,331,123 B1 12/2001 Rodrigues
6,786,757 B2 * 9/2004 Pocrass ..... 439/418
7,048,578 B2 * 5/2006 Rodrigues ..... 439/578
7,387,548 B2 * 6/2008 Takehara et al. ..... 439/843
7,537,482 B2 * 5/2009 Burris et al. ..... 439/578
7,682,206 B2 * 3/2010 Kainz ..... 439/824
2006/0246774 A1 * 11/2006 Buck ..... 439/578

OTHER PUBLICATIONS

Office Action for Canadian Patent Application No. 2,673,700, dated Jan. 19, 2011, 3 pages.

* cited by examiner

*Primary Examiner* — Renee Luebke
*Assistant Examiner* — Larisa Z Tsukerman
(74) *Attorney, Agent, or Firm* — Foley & Lardner LLP

(57) ABSTRACT

A terminal assembly is provided for terminating a center conductor of a coaxial cable. The terminal assembly includes a terminal body having a pin at one end and a cavity at the other end for accommodating a center conductor therein. A contact member is supported within the cavity. The contact member includes plural inwardly directed cantilevered beams extending from a contact base for deflectable engagement with the inserted center conductor. The terminal body includes an inwardly directed shoulder for engagement with the beams at a location between the base and the distal ends of the beams. The location defines a deflection fulcrum at a location distal from the base so as to provide increased contact engagement force between the distal ends of the beams and the center conductor.

12 Claims, 3 Drawing Sheets

CENTER CONDUCTOR TERMINAL HAVING INCREASED CONTACT RESISTANCE

CROSS REFERENCE TO RELATED APPLICATIONS

This application claims priority to U.S. Provisional Patent Application No. 61/084,290 filed on Jul. 29, 2008, the contents of which is incorporated herein by reference in its entirety.

FIELD OF THE INVENTION

The present invention relates to a terminal assembly for terminating the center conductor of a coaxial cable. More specifically, the present invention relates to a terminal assembly which provides increased contact force between a center conductor or a coaxial cable and electrical contact of a pin terminal.

BACKGROUND OF THE INVENTION

Coaxial cables are commonly used in various areas of industry, such as the cable television industry, to carry electrical signals. Coaxial cable connectors are typically used to terminate the coaxial cable to interconnect cables or to connect cables to various components. Once such coaxial connector particularly used for hard line coaxial cable is shown in commonly assigned U.S. Pat. No. 6,331,123, the disclosure of which is incorporated by reference herein for all purposes.

As is well known, a coaxial cable includes an elongate center conductor capable of transmitting electrical signals therethrough. The center conductor is typically surrounded by a dielectric covering. An outer conductor is positioned about the dielectric covering and a cable jacket surrounds the outer conductor. The cable is prepared for termination by removing a portion of the cable jacket at the distal end thereof, folding back the outer conductor and stripping away the dielectric covering from the center conductor thereby exposing an elongate extent of the center conductor. The prepared cable is inserted into a coaxial connector so that the center conductor can be electrically connected to another cable or component to effectively transmit the electrical signal therethrough.

In most instances and as shown in the above referenced incorporated patent, a pin terminal is used terminate the center conductor to allow ease of interconnection of the center conductor to another connector. The pin terminal is an elongate member having a pin at one end and a cavity at the other end. The center conductor is inserted into the cavity where mechanical and electrical engagement therebetween is achieved in order to facilitate the electrical engagement, the cavity in the pin terminal may include a contact having inwardly directed cantilevered fingers for mechanical and electrical engagement with the inserted center conductor. The cantilevered fingers function as deflectable beams to allow insertion of the center conductor therethrough.

As may be appreciated, quiet often during use and handling, and especially where the connector may be subject to temperature variations during use, the spring engagement between the cantilevered fingers and the center conductor may not be maintained consistently. Moreover, variations in the size of the components used may result in inconsistent contact engagement with the center conductor.

It is, therefore desirable to provide a pin terminal assembly which provides an increase in engagement force between the contacts supported in the pin terminal and the inserted center conductor.

SUMMARY OF THE INVENTION

The present invention provides a terminal assembly for terminating a center conductor of a coaxial cable. The terminal assembly includes a terminal body having a pin at one end and a central cavity at the other end. The central cavity accommodates the center conductor therein. The contact member is supported within the central cavity. The contact member includes a plurality of inwardly directed cantilevered beams extending from a central base. The beams are designed for deflectable electrical engagement with the inserted center conductor. The terminal body includes an inwardly directed shoulder for engagement with the beams at a location between the base and the distal ends thereof. The location defines a deflection fulcrum for the beams at a position distal of the base so as to provide increased contact engagement force between the beams and the center conductor.

The present invention further provides a coaxial cable connector including a terminal assembly as described above.

DETAILED DESCRIPTION OF THE PREFERRED EMBODIMENT

The present invention provides a pin terminal for terminating the center conductor of a coaxial cable which provides increased contact resistance between the center conductor and the pin terminal so as to assure mechanical and electrical engagement therebetween over time and temperature variations.

Figure 1:
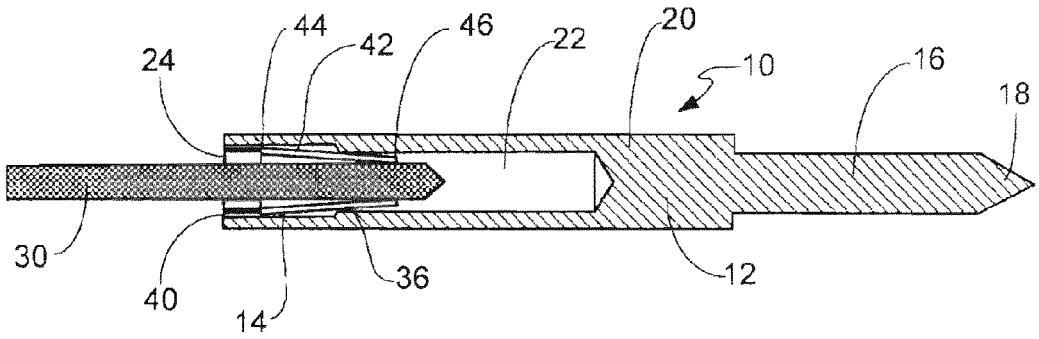
FIG. 1 is a partially sectioned view of a terminal assembly of the present invention shown terminating a central conductor of a coaxial cable.
Figure 2:
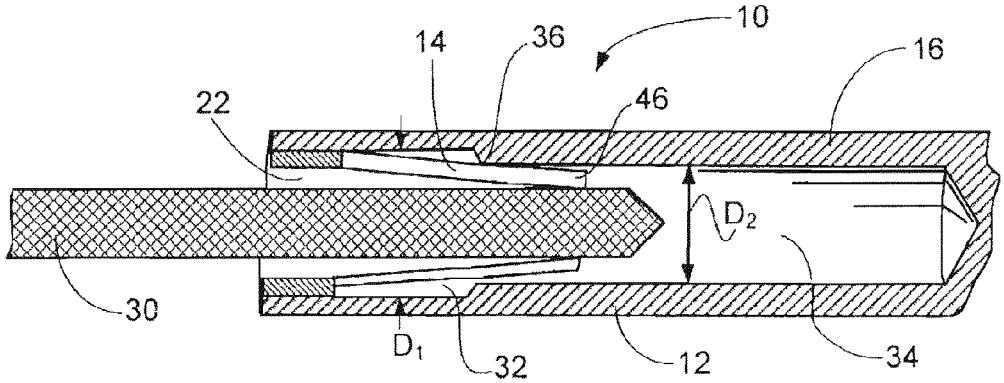
FIG. 2 is an enlarged showing of the terminal assembly of FIG. 1.

Referring now to FIGS. 1 and 2, terminal assembly 10 of the present invention includes a pin terminal 12 and a electrical contact 14. Pin terminal 12 is an elongate electrically conductive member typically formed of a suitable metallic material. Pin terminal 12 includes an elongate forward pin portion 16 extending to a distal pointed tip 18 and a rearwardly directed body portion 20 having an elongate central cavity 22 formed therein. Cavity 22 opens at the opposed distal end 24 so as to insertably accommodate a center conductor 30 of a conventional coaxial cable 50 FIG. 4. The center conductor 30, which is also formed of an electrically conductive metal is, as will be described in further detail hereinbelow, is insertably accommodated within the cavity 22 of terminal 12 so as be in mechanical and electrical engagement therewith.

As shown in FIG. 2, the cavity 22 formed in body 20 of pin terminal 12 includes a first cavity portion 32 formed adjacent open end 24 having a first diameter $D_1$. The cavity 32 has a second portion 34 longitudinally adjacent portion 32 having a diameter $D_2$ which is less than $D_1$. At the transition between portion 32 and portion 34, terminal body 20 defines an inwardly tapering annular shoulder 36 thereat.

Contact 14 includes an annular contact base 40 which may be a split ring and a plurality of cantilevered fingers or beams 42 extending from base 40. In the present embodiment, four circumferentially spaced beams 42 extend from base 40. Beams 42 are elongate members having a proximal end 44 attached to base 40 and an opposed distal end 46. The beams 42 are generally form cantilevered springs which are deflectable about proximal portion 44 at base 40. The beams 42 are deflectable so as to accommodate the insertion of center conductor 30 therethrough. At rest, the beams extend diametrically inwardly from base 40 so that the distal extents 46 are spaced apart a distance less than the diameter of the center conductor 30 so as to allow the distal extents 46 to mechanically and electrically engage the inserted center conductor. The deflection of the beams permit such insertion.

Over time during use and with various temperature fluctuations and due to variations in the diameter of the center conductor, the length of beams 42 and the'spring deflection thereof may result in insufficient contact resistance being established between the distal extents 46 and the center conductor 30. In order to assure an adequate contact resistance force being applied by the beams to the center conductor, the pin terminal 12 employs shoulders 36 to shorten the deflectable cantilevered length of beams 42. The shoulder 36 defines a location for engagement with the beams at a position between the distal extents 46 and the base 44. This location defines a deflection fulcrum closer to the distal extents 46 of the beams to thereby shorten the deflectable beam length and thereby limit deflection thereof. This provides increased contact resistance engagement with the inserted center conductor.

The distal extents 46 of beams 42 thereby provide points of higher surface pressure against the center conductor 30 so as to retain the center conductor 30 in mechanical and electrical engagement with the contact 14 thereby establishing and maintaining electrical continuity between the center conductor and the pin terminal 12.

Figure 3:
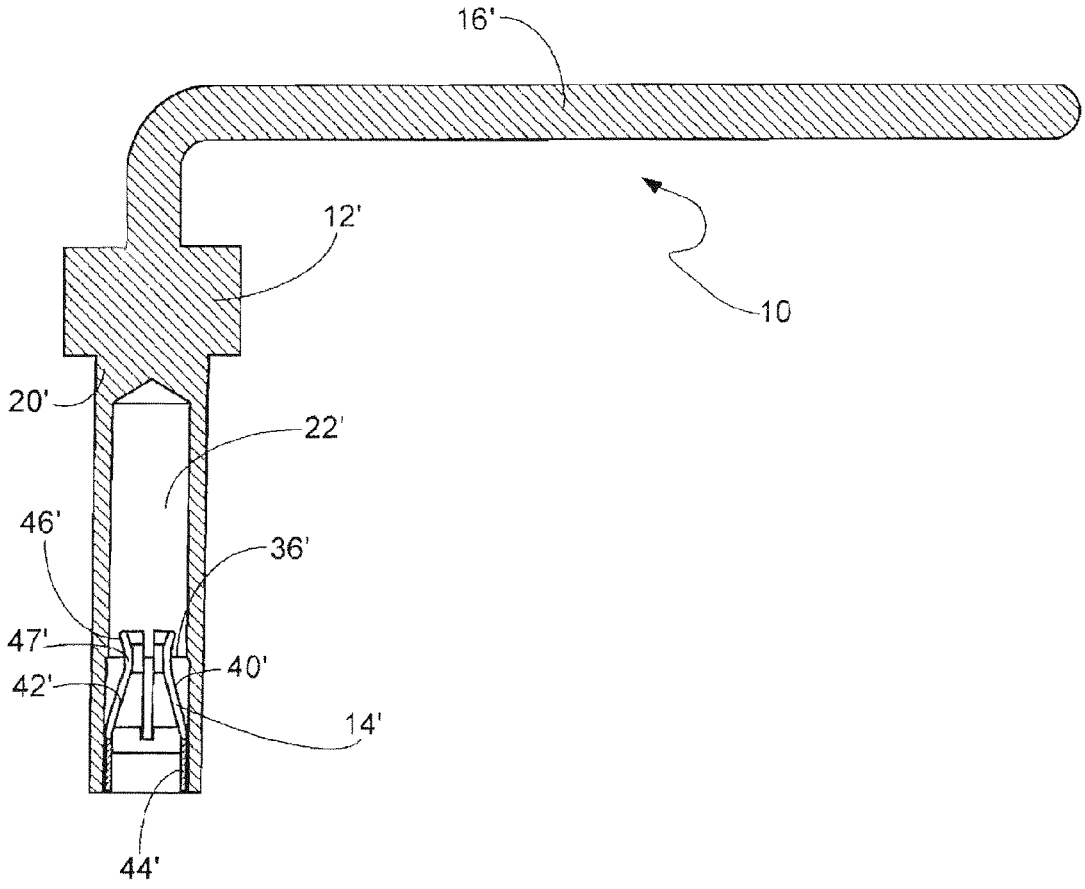
FIG. 3 is a sectional showing of a further embodiment of the pin assembly of FIG. 1.

Referring now to FIG. 3, a preferred embodiment of the pin terminal assembly of the present invention is shown. Pin terminal assembly 10' is substantially similar to pin terminal assembly 10 shown and described above. The pin terminal assembly includes a pin terminal 12' and electrical contact 14'. In the present illustrative embodiment, pin terminal 12 includes a right angle pin portion 16' which extends perpendicular to body portion 20'. A cavity 22' is formed in the lower end of body portion 20'. The cavity 22' is designed for insertable accommodation of a center conductor of a conventional coaxial cable. Cavity 22' is constructed as substantially described above with respect to the embodiment of FIG. 1 and includes an annular shoulder 36' for engagement with contact 14'.

Contact 14' includes a base 40 and a plurality of cantilevered fingers or beams 42' extending from the base 40'. In the present illustrative embodiment, the beams 42' provide a curved inwardly directed contact portions 47' adjacent the distal extent 46' thereof. The contact location 47' defines a narrow diameter for engagement with the conductor inserted therein. This narrow diameter assures engagement with inserted conductors of different diameter.

Figure 4:
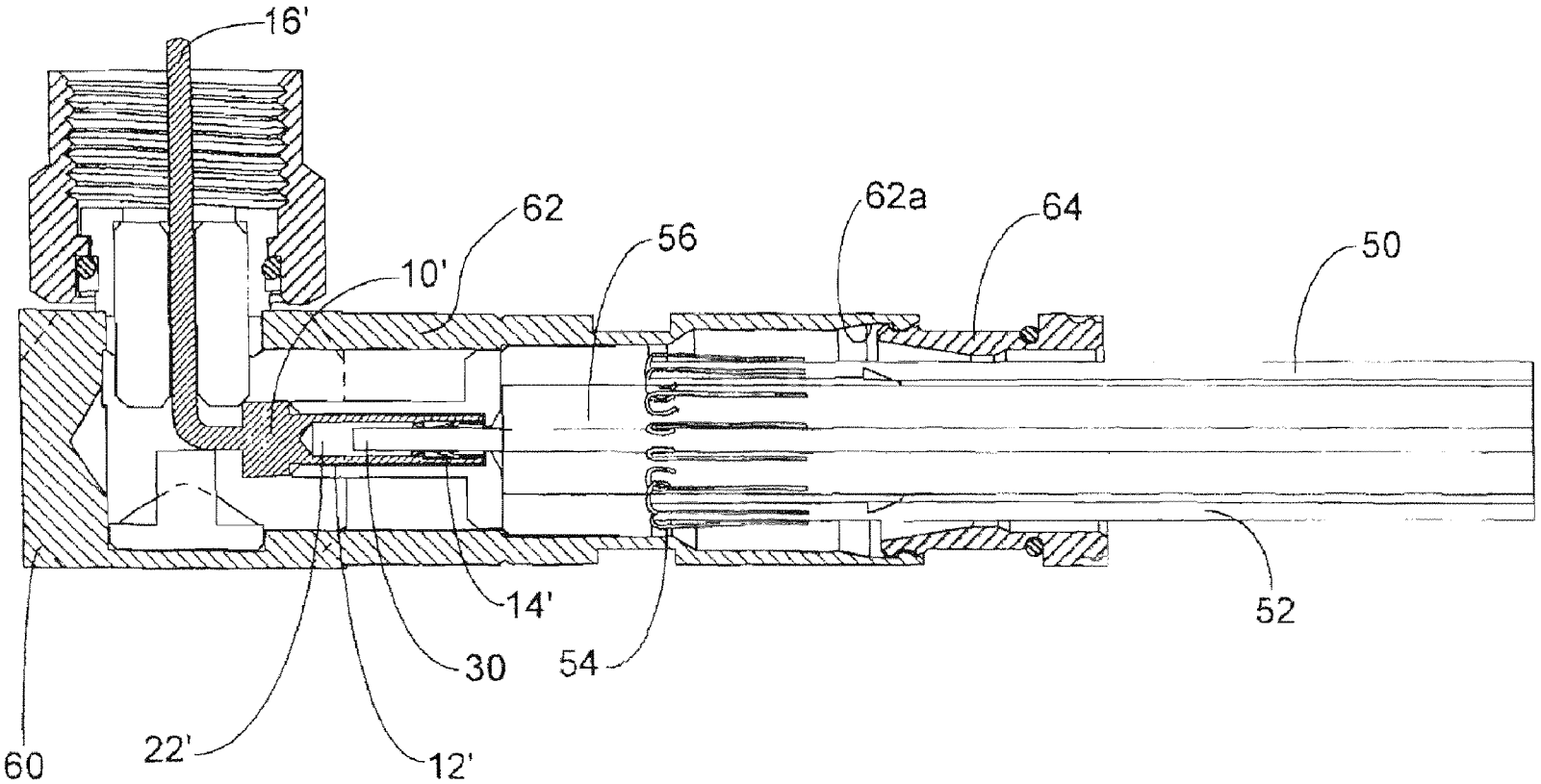
FIG. 4 is a vertical section of a coaxial connector including the pin assembly of FIG. 3.

As shown additionally in FIG. 4, the pin terminal assembly 10' of tile type described above is shown supported in a coaxial connector 60. Coaxial connector 60 is a right angle connector supporting a terminal assembly 10'. It can be appreciated, however, that other configurations of coaxial connectors and, therefore, other configurations of the terminal pin assembly may be employed within the contemplation of the present invention. Connector 60 includes a connector body 62 having a cable receiving end **62*a*. A locking sleeve 64 is insertable into the cable receiving end 62*a* to secure a coaxial cable therein. The body 62 of connector 60** includes the right angle configuration.

The pin terminal assembly 10' is shown accommodating the center conductor 30 of coaxial cable 50. Coaxial cable 50 is shown prepared as described above having a forward portion of the cable jacket 52 removed therefrom and an end portion 54 of the outer conductor folded back thereover. An end portion of the dielectric covering 56 is removed exposing the distal end of center conductor 30. The prepared coaxial cable 50 is inserted into the connector body 62 of the coaxial connector 60 so that the center conductor enters the cavity 22' of pin terminal 12'. Interconnection between the center conductor 30 and the pin terminal 12' is achieved as above described.

As shown in FIGS. 3 and 4, the contact location 47' between each proximal beam 42' and distal extent 46' makes electrical engagement with conductor 30. The shoulder 36' maintains the contact portion 47' in mechanical and electrical engagement with center conductor 30. In a manner described above, shoulder 36' serves as a fulcrum to prevent over expansion of the beams 42' as they deflect about proximal portion 44' and to maintain the contact portion 47' in engagement with the center conductor 30. Placement of the shoulder 36' at a location closer to the distal end 46' of the beams shortens the deflectable beam length and limits differentiation thereof to assure adequate electrical engagement between the center conductor 30 and the contact beams 42'.

Once the cable 50 is properly positioned within connector body 62, locking sleeve 64 may be moved forward into connector body 62 to lock the cable 50 in place. Coaxial cable 60 with the coaxial cable 50 terminated thereto may be used in conventional fashion with the electrical contact 14' supported within pin terminal 10' maintaining electrical and mechanical engagement with the center conductor 30 throughout use.

Various changes to the foregoing described and shown structures would now be evident to those skilled in the art. Accordingly, the particularly disclosed scope of the invention is set forth in the following claims.

What is claimed is:

1. A terminal assembly for terminating a center conductor of a coaxial cable comprising:

a terminal body having a pin at one end and a center cavity at the other end for accommodating said center conductor therein; and a contact member supported within said central cavity, said contact member having plural inwardly directed cantilevered beams extending inwardly away from a contact base for deflectable engagement with said inserted central conductor;

said terminal body having an inwardly directed shoulder for engagement with said beams at a location between said base and distal ends thereof;

said location defining a deflection fulcrum for said beams at a location distal of said base so as to provide an increased contact engagement force between said distal ends of said beams and said center conductor.

2. A terminal assembly of claim 1 wherein contact is press-fit into said cavity.

3. A terminal assembly of claim 1 wherein said base is an annular member and said beams extend from said base at locations spaced circumferentially thereabout.

4. A terminal assembly of claim 1 wherein said contact beams provide said contact engagement force with said center conductor having a range of diameters.

5. A terminal assembly of claim 1 wherein said terminal body, said contact member and said center conductor are formed of conductive material.

6. A connector of claim 1 wherein said pin is a right angle pin.

7. A coaxial connector for terminating a coaxial cable having a center connector extending from one end thereof, said connector comprising:

a connector body having a cable receiving end;

a terminal body supported within connector body, said terminal body having a pin at one end and a cavity at the other end for accommodating said inserted center connector, a contact member supported within said cavity, said contact member having at least one inwardly directed cantilevered beam for deflectable engagement with said inserted center connector; said beam extending inwardly from a base portion;

said terminal body having an inwardly directed shoulder for engagement with said beam at a location spaced apart from said base portion, said location defining a deflection fulcrum so as to provide increased engagement force between said beam and said center connector; and a locking sleeve insertable into said cable receiving end of said connector body and movable to lock said cable in said connector body.

8. A connector of claim 7 wherein said contact member includes a plurality of said cantilevered beams.

9. A connector of claim 8 wherein said plural beams extend from a contact base to said distal ends thereof.

10. A connector of claim 9 wherein said location is defined between said contact base and said contact distal ends of said beams.

11. A connector of claim 10 wherein each said beam includes a contact portion adjacent said distal end for engagement with said center conductor.

12. A connector of claim 11 wherein said contact portion is curved.

* * * * *